US006809478B2

(12) United States Patent
Yoshida et al.

(10) Patent No.: US 6,809,478 B2
(45) Date of Patent: Oct. 26, 2004

(54) METAL HALIDE LAMP FOR AUTOMOBILE HEADLIGHT

(75) Inventors: Masato Yoshida, Takatsuki (JP); Hideaki Kiryu, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 58 days.

(21) Appl. No.: 10/296,731

(22) PCT Filed: Mar. 27, 2002

(86) PCT No.: PCT/JP02/02952

§ 371 (c)(1),
(2), (4) Date: Nov. 25, 2002

(87) PCT Pub. No.: WO02/082500

PCT Pub. Date: Oct. 17, 2002

(65) Prior Publication Data

US 2003/0178940 A1 Sep. 25, 2003

(30) Foreign Application Priority Data

Mar. 30, 2001 (JP) ..... 2001-101562

(51) Int. Cl.[7] ..... H01J 17/04; H01J 61/04

(52) U.S. Cl. ..... 313/633; 313/637; 313/638; 313/639; 313/631; 313/623; 313/625; 313/641; 313/642; 313/571; 313/572

(58) Field of Search ..... 313/571, 572, 313/623, 625, 631, 641, 642, 637–639, 633

(56) References Cited

U.S. PATENT DOCUMENTS 4,968,916 A 11/1990 Davenport et al.
5,374,872 A 12/1994 Balaschak et al.
5,629,585 A 5/1997 Altmann et al.
5,936,350 A 8/1999 Yoshida et al.
6,075,314 A * 6/2000 Huettinger et al. ..... 313/332
6,137,228 A 10/2000 Aizawa et al.
6,456,008 B1 * 9/2002 Fukuyo et al. ..... 313/638
6,476,555 B1 * 11/2002 Yoshida et al. ..... 313/623
6,646,380 B1 * 11/2003 Kubon et al. ..... 313/631

FOREIGN PATENT DOCUMENTS

| | | |
|---|---|---|
| EP | 0 581 354 | 2/1994 |
| EP | 0 903 771 | 3/1999 |
| JP | 42-27212 | 12/1967 |
| JP | 58-157047 | 9/1983 |
| JP | 4-132154 | 5/1992 |
| JP | 6-89703 | 3/1994 |
| JP | 7-21981 | 1/1995 |
| JP | 7-282719 | 10/1995 |
| JP | 9-15286 | 2/1997 |
| JP | 10-223175 | 8/1998 |
| JP | 10-269941 | 10/1998 |

* cited by examiner

*Primary Examiner*—Nimeshkumar D. Patel
*Assistant Examiner*—Matt Hodges
(74) *Attorney, Agent, or Firm*—Merchant & Gould P.C.

(57) ABSTRACT

A metal halide lamp for an automobile headlight is provided, which includes an arc tube in which a pair of tungsten electrodes are provided at both ends and a metal halide as a main component of a luminescent material and xenon gas as a buffer gas are sealed, wherein the tungsten electrodes contain not more than 0.4 wt % of thorium oxide, the metal halide contains scandium iodide, and a pressure of the xenon sealed in the arc tube is at least 0.4 MPa. This makes it possible to provide a long-life metal halide lamp for an automobile headlight that can achieve a further improved lumen maintenance factor and other life characteristics during 2000 hours or more of lighting.

27 Claims, 10 Drawing Sheets

METAL HALIDE LAMP FOR AUTOMOBILE HEADLIGHT

TECHNICAL FIELD

The present invention relates to a structure of a metal halide lamp for an automobile headlight.

BACKGROUND ART

In recent years, as a lamp for an automobile headlight, a new small metal halide lamp that can be substituted for a conventional tungsten halogen lamp has been developed and commercially expanded. This metal halide lamp has the advantage that it can achieve a luminous flux three times as high as that of the conventional tungsten halogen lamp while the 35 W lamp power of the metal halide lamp is smaller than the 55 W lamp power of the conventional tungsten halogen lamp. On this account, the spread of this metal halide lamp has been promoted as a next-generation lamp capable of achieving improved brightness as well as energy saving and allowing still safer drive of an automobile, particularly at night.

FIG. 9 shows a structure of an arc tube of such a metal halide lamp for an automobile headlight. An arc tube 19 of the lamp has the structure as follows. An envelope 20 of the arc tube is made of quartz, and electrodes 21 and 22 made of a pair of tungsten bars are provided at both ends of the arc tube. Molybdenum foils 25 and 26 are sealed hermetically in sealing end parts 23 and 24 of the envelope 20, and a rear end of the tungsten electrode 21 is welded and connected to one end of the molybdenum foil 25 and a rear end of the tungsten electrode 22 is welded and connected to one end of the molybdenum foil 26. External leads 27 and 28 are welded and connected to the other ends of the molybdenum foils 25 and 26, respectively. Inside the arc tube, 0.01 to 1.0 mg of a mixture of scandium iodide and sodium iodide ($NaI+ScI_3$) is sealed as a main component of a luminescent material 29 together with 0.1 to 1.0 mg of mercury and 0.1 to 1.5 MPa of xenon as buffer gases 30. Typically, the size of the arc tube 19 is such that the distance Le between the electrodes is 4.2 mm, the inner diameter $\phi i$ of the arc tube is 2.8 mm, and the inner volume of the arc tube is 30 $mm^3$ at maximum. It is to be noted here that other metal halide materials such as $ThI_4$, LiI, TlI, and the like also may be sealed in the arc tube.

The lighting operation of the above-mentioned metal halide lamp for an automobile headlight is different from that of a normal metal halide lamp for general lighting. Specifically, during the lighting operation of the above-mentioned metal halide lamp, flickering occurs repeatedly, including the flickering at the time of a so-called "instantaneous restart". Besides, in order to obtain the required luminous flux immediately after the lamp is turned on, the lamp immediately after being turned on is subjected to a lamp current of 2.6 A, which is about seven times as high as the lamp current of 0.4 A during the steady-state lighting. As described above, the metal halide lamp for an automobile headlight is operated according to a unique, relatively demanding lighting system.

At the beginning of the development of the conventional metal halide lamp shown in FIG. 9, a first problem was found that the quartz present in the sealing end parts 23 and 24 of the envelope 20 of the arc tube 19, especially around portions of the tungsten electrodes 21 and 22 sealed therein (hereinafter, such portions are referred to as "sealed portions"), may have cracks and/or may be damaged within a relatively short time of 500 hours or less, resulting in a short lifetime of the lamp. It can be said that this problem is related to the unique lighting system as described above.

Since then, various studies have been made to solve the above-mentioned problem, and means for solving the problem are disclosed, for example, in JP 7(1995)-282719 A, JP 7(1995)-21981 A, JP 10(1998)-223175 A, JP 10(1998)-269941 A, etc.

As a means for preventing the occurrence of cracks and/or damage in the quartz present around the sealed portions of the electrodes, electrodes 21 and 22 made of a so-called "thoriated tungsten material" that contains thorium oxide ($ThO_2$) as an additive particularly in an amount of 1 to 2 wt % has been employed. By using such electrodes, the adhesive strength between the electrodes and the quartz can be increased. Further, as shown in an enlarged view of FIG. 10 illustrating the sealing end part 23 of the envelope, a quartz coating 31, which is not mechanically connected to the quartz present in the sealing end part 23, is formed on the periphery of the tungsten electrode 21 (The same occurs on the periphery of the tungsten electrode 22).

As a result, the quartz present in the sealing end part 23 is no longer subject to stress distortion due to the difference in thermal expansion between the tungsten electrode 21 and the quartz at the time of the flickering of the arc tube 19. Cracks and/or damage occurring in the quartz present in the sealing end part 23 thus can be prevented. Since this means is extremely effective in preventing the occurrence of cracks and/or damage in the quartz, it has been a major technique generally applied to the conventional lamp shown in FIG. 9.

Another effective means is winding a tungsten coil 32 on the periphery of the sealed portion of the tungsten electrode 21 of the arc tube 19 as shown in FIG. 11. In contrast to the case where the above-mentioned means using the thoriated tungsten electrodes is employed, the adhesion between the tungsten electrode 21 in the sealing end part 23 of the envelope and the quartz on the periphery of the electrode 21 is made very weak by using the tungsten coil 32. However, in this case, the quartz on the periphery of the electrode still is subjected to less stress distortion at the time of the flickering of the arc tube, thereby allowing cracks and/or damage occurring in the quartz to be prevented. It is to be noted that similar means have been applied to a conventional tungsten halogen lamp.

A second problem found in the development of the conventional metal halide lamp shown in FIG. 9 is that the lumen maintenance factor of the arc tube 19 decreases with the passage of time after the lamp is turned on. As described above, the arc tube 19 having a small volume is operated at a lamp power of 35 W in the steady state. In addition, the arc tube 19 is operated according to a demanding lighting system in which instantaneous restart, high-current operation immediately after the lamp is turned on, etc. are required. Thus, the operating temperature of the envelope 20 made of quartz rises particularly remarkably to reach 1000° C. or more, and the tungsten electrodes 21 and 22 are evaporated and/or worn away considerably, which cause devitrification and blackening of the envelope 20. Therefore, the decrease in lumen maintenance factor of the lamp due to the devitrification and blackening of the envelope 20 cannot be avoided.

As disclosed in JP 7(1995)-21981 A, for example, the thoriated tungsten electrodes 21 and 22 containing $ThO_2$ as a means for solving the first problem has been regarded as effective also in solving the second problem and employed as a means for solving the second problem. Conventionally, there has been a widely accepted theory as follows in the art. That is, in a high-pressure discharge lamp employing the thoriated tungsten electrodes, a monatomic layer of Th is formed during the lamp operation to decrease the work function at front ends of the tungsten electrodes and thus decrease the operating temperature thereof considerably, thereby suppressing the blackening of the arc tube caused mainly by the tungsten evaporated from the tungsten electrodes. In fact, in a conventional NaI—$ScI_3$-based metal halide lamp for general lighting, thoriated tungsten electrodes generally have been used to suppress a decrease in the lumen maintenance factor caused by the blackening of the arc tube during the lifetime of the lamp.

As a specific means for solving the second problem, a manufacturing process has been developed and introduced into service that provides a high-purity lamp by sufficiently removing impurities such as $H_2O$ contained in a sealed luminescent material and in quartz forming an envelope as well as impurities such as $H_2O$ and $O_2$ that entered during the manufacturing process. According to this process, the conventional metal halide lamp shown in FIG. 9 achieved the required average lumen maintenance factor of 70% during the lifetime of 1500 hours, which is the required lifetime in the early stages of its development. It is to be noted that the lumen maintenance factor is determined as a percentage of the luminous flux after 15-hour aging to an initial luminous flux.

In recent years, the metal halide lamp for an automobile headlight is facing a new task of extending its lifetime. The lifetime of 1500 hours at the early stages of its development is determined considering the cracks and/or damage occurring mainly in the quartz present in the sealing end parts of the envelope of the arc tube. However, since this problem was solved by the above-mentioned means, there has been a demand from users that the lifetime of 1500 hours required in the early stages of its development should be extended to 2000 hours or more. The lifetime of 2000 hours or more corresponds to an average travel distance of about 100,000 km or more of an automobile and thus allows the lamp to be treated as a substantially maintenance-free component. This provides a great advantage to the users.

According to an actual life test for 1500 hours or more conducted with respect to the conventional metal halide lamp, it has been revealed that, in addition to the problem (a) that the average lumen maintenance factor decreases to be below the required value of 70%, the following new problems (b)–(d) occur remarkably during the lifetime of 1500 hours or more for the metal halide lamp: (b) color temperature and/or chromaticity coordinates are changed; (c) the luminance at the center of the arc (hereinafter, referred to as "arc center luminance") may be decreased due to the diffusion of an arc discharge region in the arc tube oriented so as to extend horizontally during lighting; and (d) the arc tube is expanded (the inner diameter of the envelope is increased) by the heat generated during lighting.

As described above, in order to realize a long-life metal halide lamp for an automobile headlight having a lifetime of 2000 hours or more in response to the users' demand, a major technical task specifically is improving the average lumen maintenance factor so as to achieve the required value of 70% or more during such a long lifetime of the lamp as well as further improving other life characteristics of the lamp.

DISCLOSURE OF INVENTION

The present invention is intended to solve the above-mentioned problems in the prior art. It is an object of the present invention to provide a long-life metal halide lamp for an automobile headlight that can achieve a further improved lumen maintenance factor and other life characteristics during 2000 hours or more of lighting.

In order to achieve the above-mentioned object, a metal halide lamp for an automobile headlight according to the present invention includes an arc tube in which a pair of tungsten electrodes are provided at both ends and a metal halide as a main component of a luminescent material and xenon gas as a buffer gas are sealed, wherein the tungsten electrodes contain not more than 0.4 wt % of thorium oxide, and the metal halide contains scandium iodide.

This makes it possible to achieve the required average lumen maintenance factor of 70% or more during the lifetime of 2000 hours. Besides, changes in color temperature, expansion of the arc tube due to the heat generated during lighting, and a decrease in the arc center luminance can be suppressed. As a result, a long-life lamp having a lifetime of 2000 hours or more can be provided to satisfy the users' demand.

Further, in the metal halide lamp for an automobile headlight according to the present invention, a pressure of the xenon sealed in the arc tube is at least 0.4 MPa.

This makes it possible to suppress the blackening of the arc tube caused by evaporation and/or wear of the tungsten electrodes in spite of the fact that the tungsten electrodes in the lamp according to the present invention contain a smaller amount of thorium oxide as compared with those in the conventional lamp. Thus, the lamp can achieve the required average lumen maintenance factor of 70% or more during the lifetime of 2000 hours. As a result, a long-life lamp having a lifetime of 2000 hours or more can be provided to satisfy the users' demand.

Further, considering the pressure resistance of the arc tube, it is preferable that the pressure of the xenon sealed in the arc tube is not more than 1.0 MPa. Of course, the upper limit of the pressure varies depending on the thickness and the like of the arc tube.

Furthermore, in the metal halide lamp for an automobile headlight according to the present invention, a lamp current at least three times higher than that applied during steady-state lighting is applied to the metal halide lamp during a period after the lamp is turned on and until the steady-state lighting is established.

Still further, in the metal halide lamp for an automobile headlight according to the present invention, it is preferable that the following relationship is satisfied:

$$(1/12 \times m_e + m_x)/V \geqq 5 (\mathrm{mg/mm^3})$$

where V ($mm^3$) represents an inner volume of the arc tube, $m_e$ (mg) represents a total weight of thorium elements contained in portions of the tungsten electrodes protruding into a hollow space inside the arc tube, and $m_x$ (mg) represents a total weight of thorium elements present in the hollow space except for those contained in the portions of the tungsten electrodes protruding into the hollow space.

This makes it possible to prevent the cracks and/or damage liable to occur in the quartz present in the vicinity of the electrode-side ends of the molybdenum foils in the sealing end parts of the envelope of the arc tube during 2000 hours or more of lighting. As a result, a long-life lamp having a lifetime of 2000 hours or more can be provided to satisfy the users' demand.

Still further, in the metal halide lamp for an automobile headlight according to the present invention, it is preferable that the tungsten electrodes contain not more than 0.2 wt % of thorium oxide.

This makes it possible to further improve a lumen maintenance factor and other various life characteristics during 2000 hours or more of lighting. As a result, a long-life lamp having a lifetime of 2000 hours or more and also a still higher quality can be provided to satisfy the users' demand.

Still further, in the metal halide lamp for an automobile headlight according to the present invention, it is preferable that the metal halide contains sodium iodide.

Still further, in the metal halide lamp for an automobile headlight according to the present invention, it is preferable that, between each of the tungsten electrodes and the arc tube, a buffer member for reducing stress distortion due to a difference in thermal expansion between each of the tungsten electrodes and the arc tube is provided.

Still further, in the metal halide lamp for an automobile headlight according to the present invention, it is preferable that the buffer member is an intermediate sealing glass having a thermal expansion coefficient smaller than that of tungsten and greater than that of quartz.

Still further, in the metal halide lamp for an automobile headlight according to the present invention, it is preferable that the buffer member is a tungsten coil wound around a portion of each of the tungsten electrodes that is sealed in a sealing end part of an envelope.

This makes it possible to prevent the occurrence of cracks and/or damage in the quartz present around the tungsten electrodes in the sealing end parts of the envelope when the lamp is turned on or turned off in spite of the fact that the tungsten electrodes in the lamp according to the present invention contain a smaller amount of thorium oxide as compared with those in the conventional lamp. As a result, a long-life lamp having a lifetime of 2000 hours or more can be provided to satisfy the users' demand.

Still further, in the metal halide lamp for an automobile headlight according to the present invention, it is preferable that a portion of each of the tungsten electrodes that is sealed in a sealing end part of an envelope is coated with at least one material selected from the group consisting of rhenium, platinum, rhodium, ruthenium, and gold.

This makes it possible to prevent the occurrence of the cracks and/or damage in the quartz present around the tungsten electrodes in the sealing end parts of the envelope when the lamp is turned on or turned off in spite of the fact that the tungsten electrodes in the lamp according to the present invention contain a smaller amount of thorium oxide as compared with those in the conventional lamp. As a result, a long-life lamp having a lifetime of 2000 hours or more can be provided to satisfy the users' demand.

Still further, in the metal halide lamp for an automobile headlight according to the present invention, it is preferable that a metal foil is sealed in each sealing end part of an envelope of the arc tube, and each of the tungsten electrodes is connected electrically to the metal foil via a buffer member for reducing stress distortion due to a difference in thermal expansion between each of the tungsten electrode and the arc tube.

Still further, in the metal halide lamp for an automobile headlight according to the present invention, it is preferable that the buffer member is a conductive member having a thermal expansion coefficient smaller than that of tungsten and greater than that of quartz.

BEST MODE FOR CARRYING OUT THE INVENTION

Hereinafter, embodiments of the present invention will be described with reference to FIGS. 1 to 8.

Figure 1:
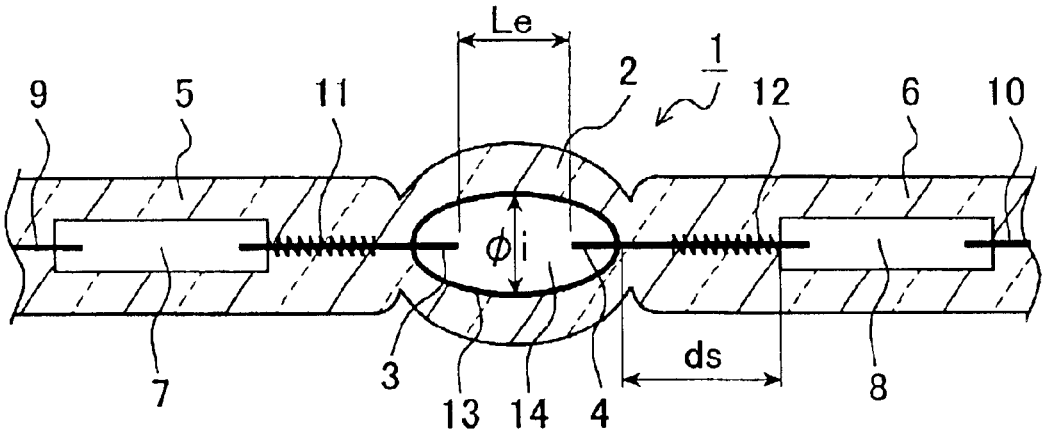
FIG. 1 is a cross-sectional view showing an arc tube of a metal halide lamp for an automobile headlight according to the present invention.
Figure 2:
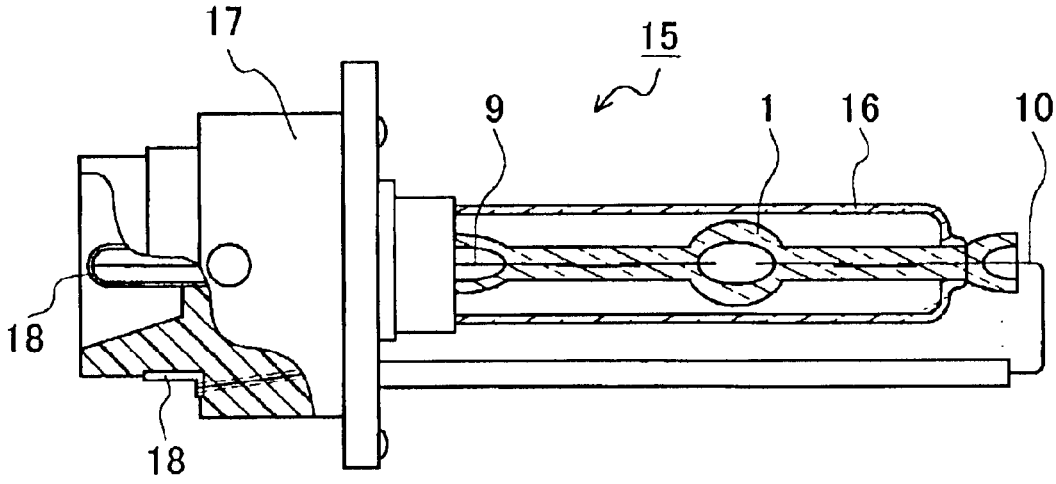
FIG. 2 is a cross-sectional view showing main parts of a metal halide lamp for an automobile headlight according to the present invention.
Figure 3:
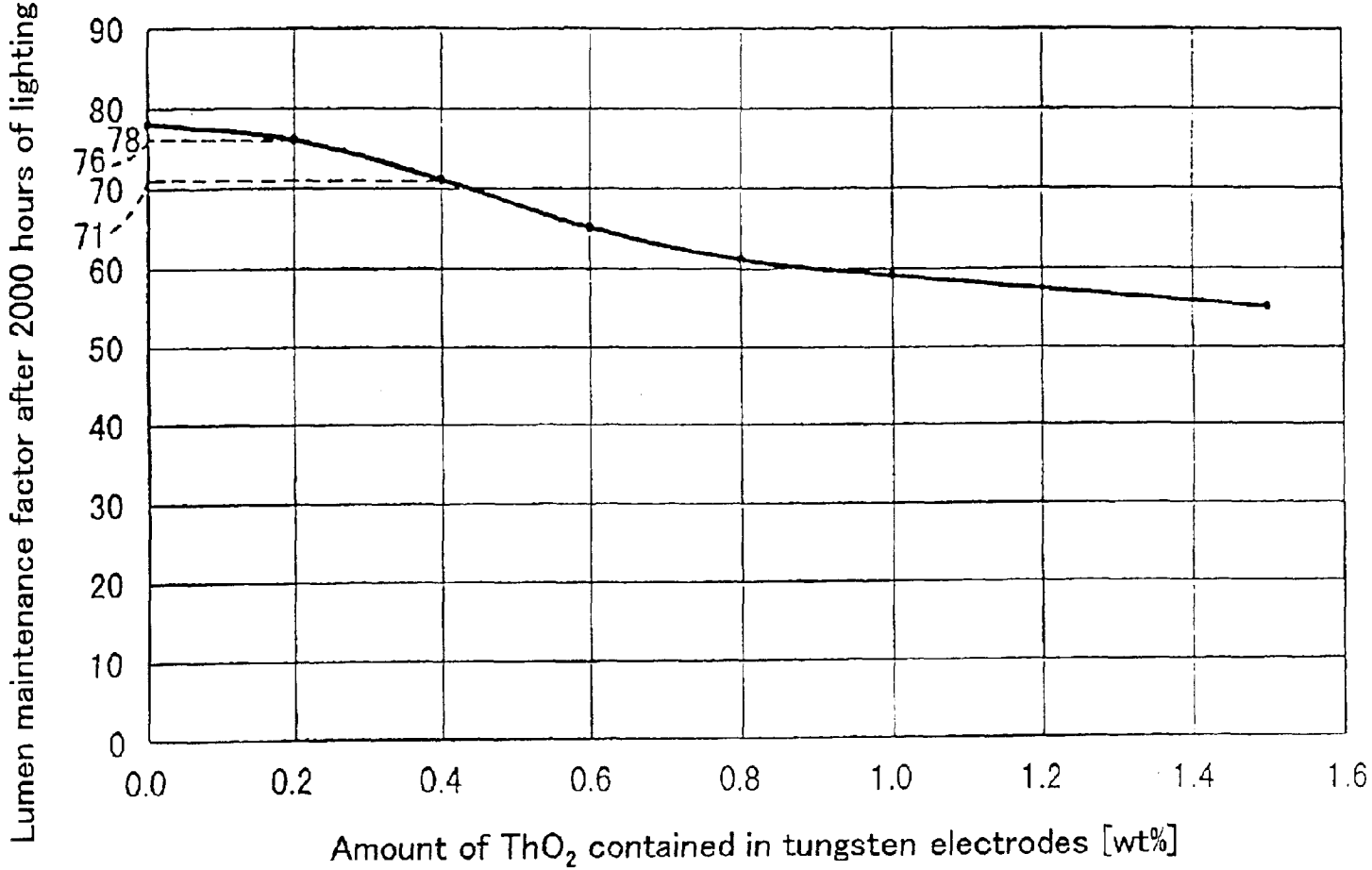
FIG. 3 is a graph showing the relationship between the lumen maintenance factor after 2000 hours of lighting and an amount of $ThO_2$ contained in tungsten electrodes.
Figure 4:
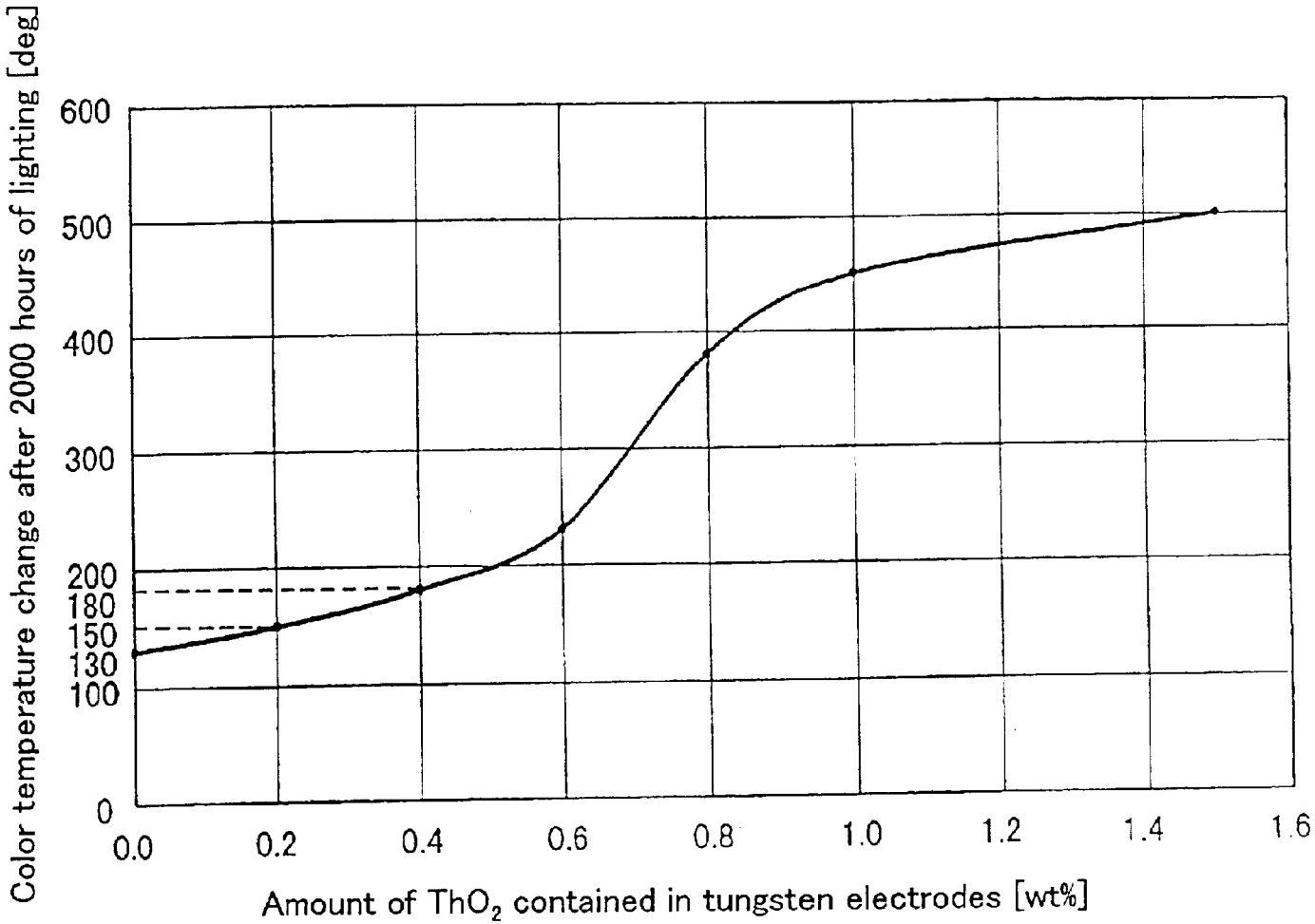
FIG. 4 is a graph showing the relationship between the color temperature change after 2000 hours of lighting and an amount of $ThO_2$ contained in tungsten electrodes.
Figure 5:
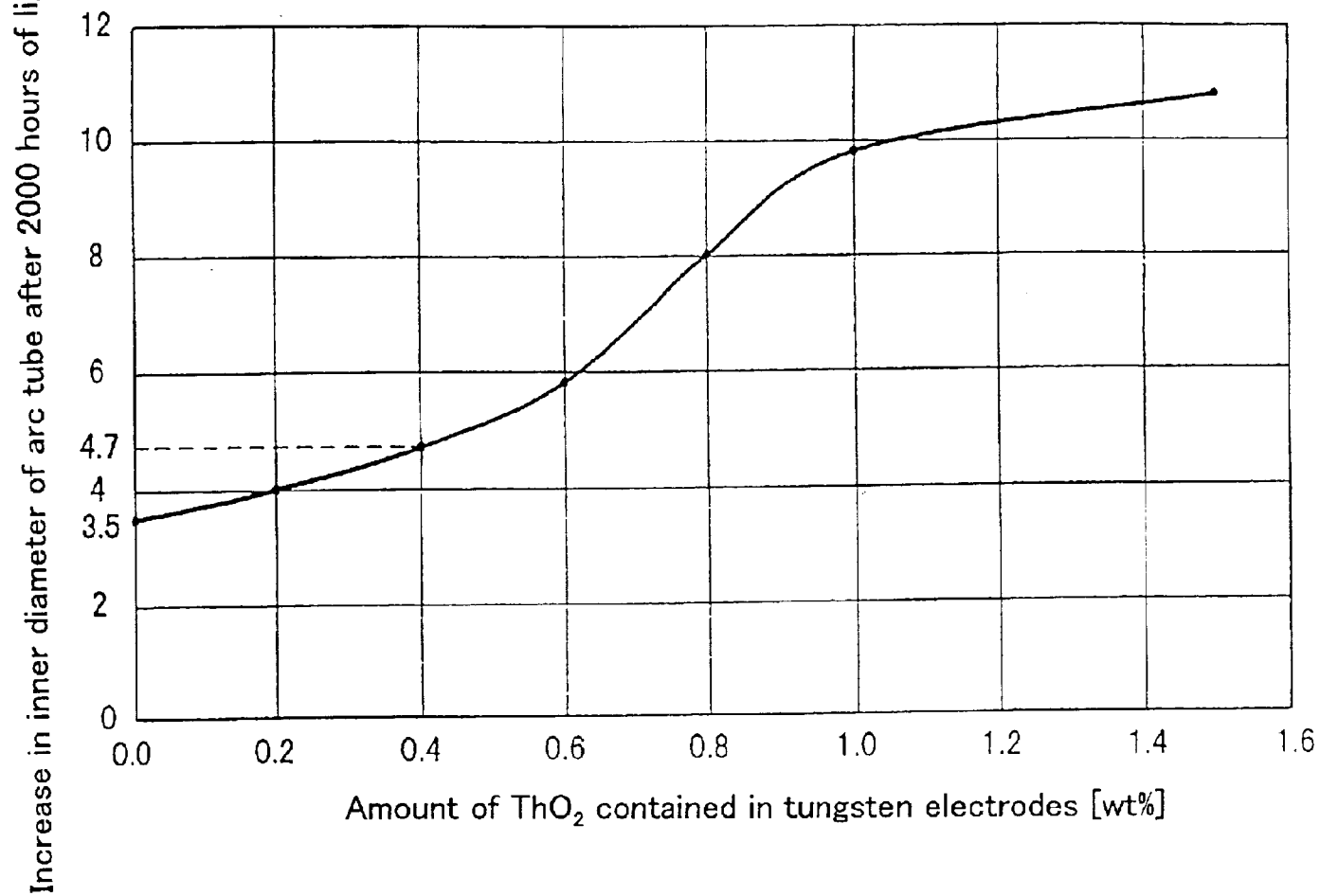
FIG. 5 is a graph showing the relationship between an increase in an inner diameter of an arc tube after 2000 hours of lighting and an amount of $ThO_2$ contained in tungsten electrodes.
Figure 6:
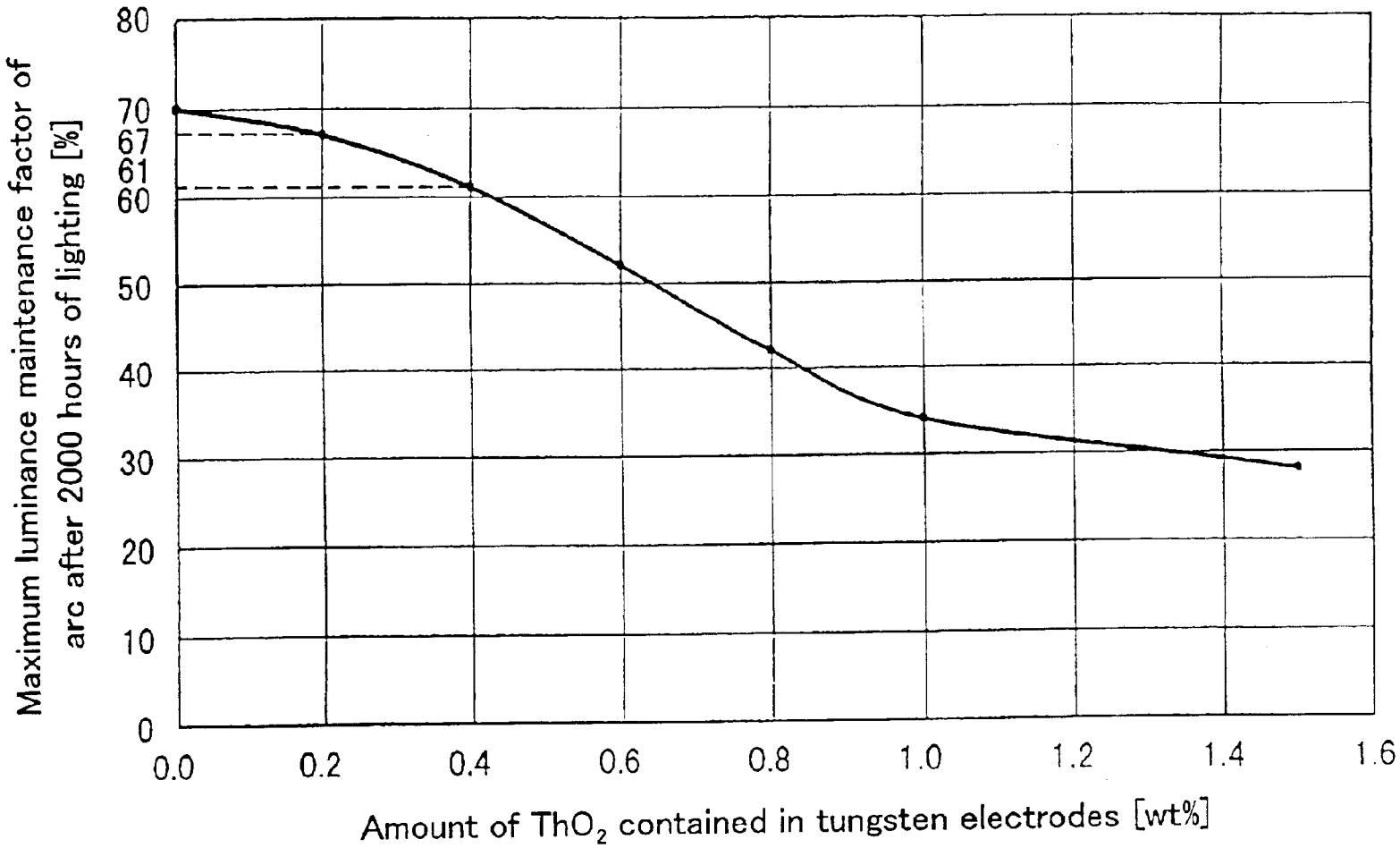
FIG. 6 is a graph showing the relationship between the maximum luminance maintenance factor of the arc after 2000 hours of lighting and an amount of $ThO_2$ contained in tungsten electrodes.

FIG. 1 shows a structure of an arc tube of a 35 W metal halide lamp for an automobile headlight according to the present invention. The structure of the arc tube basically is the same as that of the arc tube of the above-mentioned conventional metal halide lamp. Further, FIG. 2 shows an entire structure of a metal halide lamp according to the present invention.

An arc tube 1 of the lamp has the structure as follows. An envelope 2 of the arc tube 1 is made of quartz, and electrodes 3 and 4 made of a pair of tungsten bars (the electrode bars are 0.25 mm in diameter and 7 mm in total length with 6.0 mm being a length ds of the sealed portions) are provided at both ends of the arc tube. Molybdenum foils 7 and 8 (1.5 mm in width and 7 mm in total length) are sealed hermetically in sealing end parts 5 and 6 of the envelope, and a rear end of the tungsten electrode 3 is welded and connected to one end of the molybdenum foil 7 and a rear end of the tungsten electrode 4 is welded and connected to one end of the molybdenum foil 8. External leads 9 and 10 (0.4 mm in diameter) are welded and connected to the other ends of the molybdenum foils 7 and 8, respectively. In this case, tungsten coils 11 and 12 as a buffer member are wound around the sealed portions of the tungsten electrodes 3 and 4 in the sealing end parts 5 and 6 of the envelope (the coil has a wire diameter of 0.10 mm and is wound by 20 turns at a pitch of 0.20 mm). Inside the arc tube, at least scandium iodide and sodium iodide ($NaI+ScI_3$) are sealed as a main component of a luminescent material 13 together with 0.8 mg of mercury and 0.7 MPa of xenon as buffer gases 14. The size of the arc tube 1 is such that the distance Le between the electrodes is 4.2 mm, the inner diameter $\phi i$ of the arc tube is 2.8 mm, and the inner volume of the arc tube is 30 $mm^3$ at maximum. It is to be noted here that, instead of winding the tungsten coils 11 and 12 around the sealed portions of the tungsten electrodes 3 and 4 in the sealing end parts of the envelope, rhenium, platinum, rhodium, ruthenium, gold, or the like may be coated thereon.

The completed lamp 15 has the structure as follows. The above-mentioned arc tube 1 is disposed inside an outer tube envelope 16 made of ultraviolet-ray shielding glass, and a lamp base 17 is attached to the outer tube envelope 16. The external leads 9 and 10 are connected to terminals of the lamp base 17, respectively, via connecting conductive wires 18 and the like.

The above-mentioned lamp 15 is installed in a light fixture, equipped with a reflecting mirror, for an automobile headlight so that the arc tube 1 is oriented so as to extend horizontally. The lamp 15 is operated by an electronic ballast that applies a rectangular wave voltage of about 100 to 400 Hz frequency during the steady-state lighting. Further, as described above, the lamp 15 is turned on by applying a high-pressure pulse voltage of about 20 kV at the time of instantaneous restart, and the lighting operation immediately after the lamp is turned on is performed by applying a current that is about seven times as high as the current, 0.4 A, applied to the lamp during the steady-state lighting.

First, the inventors of the present invention carried out a life test with respect to two types of lamps 15. The lamps 15 in which tungsten electrodes 3 and 4 in arc tubes 1 having the structure as shown in FIG. 1 are formed using thoriated tungsten materials containing 1.0 wt % $ThO_2$ and 1.5 wt % $ThO_2$, respectively, according to the prior art. The life test was conducted for 1500 hours or more with the lamps 15 being installed in a light fixture to examine their life characteristics. In this case, 0.2 mg of a mixture containing sodium iodide, scandium iodide, and thorium iodide in the composition ratio of $NaI:ScI_3:ThI_4$=70 wt %:29 wt %:1 wt % was sealed in the arc tubes of the lamps 15 as a luminescent material 13.

Figure 7:
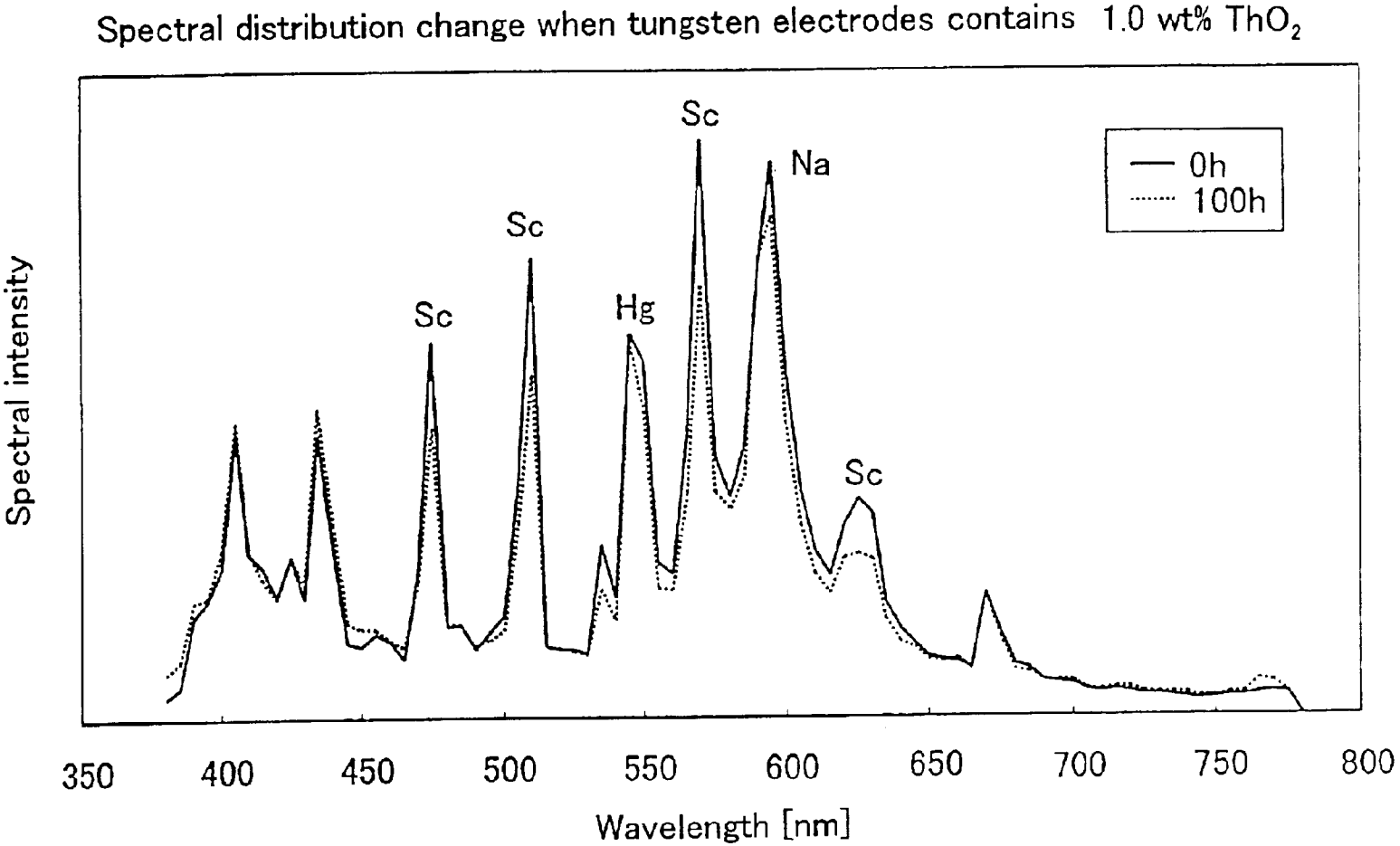
FIG. 7 is a graph showing a spectral distribution during the lifetime of a metal halide lamp depending on an amount of $ThO_2$ contained in tungsten electrodes of the lamp.

From the results of this life test, it was found that, during the targeted lifetime of 2000 hours for the lamps 15, the average lumen maintenance factor decreased to 59% (required value: 70%); chromaticity coordinates x and y of the luminous color were both shifted in the positive direction (i.e., toward a pink region); and the average color temperature of the luminous color decreased from 4000 K by about 500 deg. Also, it was found that as upper portions of the envelopes 2 of the arc tubes, which extend horizontally in the lamps 15, were expanded due to a temperature rise to increase the inner diameter of the arc tubes, the width of the arc discharge region (the width is determined as a value including ±20% deviation from the width of the region in which a luminance of 100% is obtained) of the arc tubes 1 were diffused so that the relative arc center luminance decreased to be 30% of the initial value. On the other hand, from the observation of the emission spectrum distribution of the lamps 15 during the life test, it was found that the spectral intensity of Sc decreased after 100 hours of lighting as shown in FIG. 7. This means $ScI_3$ in the arc tube was exhausted. Also, it was observed that, with a decrease in the spectral intensity of Sc, the devitrification of the quartz present especially in the envelopes 2 of the arc tubes 1 became considerable.

At first, the inventors of the present invention studied how to improve the life characteristics of the lamps 15 employing the conventional thoriated tungsten electrodes as described above.

For example, in view of the above-mentioned test results showing that the spectral intensity of Sc decreased with the passage of time after the lamps were turned on, thereby causing the luminous color to be shifted toward a pink region, the inventors of the present invention assumed that an absolute amount of $ScI_3$ in the luminescent material 13 sealed in the arc tubes was not sufficient for the targeted lifetime of 2000 hours. Based on this assumption, the inventors increased the amount of the luminescent material 13 containing NaI, $ScI_3$, and $ThI_4$ in the same composition ratio as described above gradually from 0.2 mg to 1.0 mg. As a result, it was found that, although the decrease in the spectral intensity of Sc and the luminous color shift were suppressed, a new problem arose that, especially when the absolute amount of $ScI_3$ sealed in the arc tubes was increased to 0.1 mg or more, a lot of cracks and/or damage newly occurred in the quartz present in the vicinity of the electrode-side ends of the molybdenum foils 7 and 8 in the sealing end parts 5 and 6 of the envelope of the arc tubes 1, especially after 1500 hours or more of lighting, so that the lifetime of the lamp expired. Also, it was found that the lumen maintenance factor decreased with an increase in the absolute amount of $SCI_3$, although the improvement thereof is a matter of highest priority. Especially when the absolute amount of $ScI_3$ sealed in the arc tubes was 0.1 mg or more as described above, devitrification of the envelopes 2 of the arc tubes 1 due to recrystallization was so considerable that the required average lumen maintenance factor of 70% or more could never be achieved. This is caused by the fact that, the $ScI_3$ added to increase its amount was not yet vaporized and present in the liquid phase during lighting, and the $ScI_3$ present in the liquid phase reacted with the envelopes 2 made of quartz to accelerate their devitrification.

As described above, it became evident that it is difficult to achieve the object of the present invention to provide a lamp having the targeted lifetime of 2000 hours by increasing the absolute amount of $ScI_3$.

Next, the inventors of the present invention investigated a basic factor that deteriorates the life characteristics of the above-mentioned lamps 15 employing the conventional thoriated tungsten electrodes. As a result of the investigation, it was finally confirmed that the $ThO_2$ contained in the tungsten electrodes itself is the factor, as specifically described below.

Figure 8:
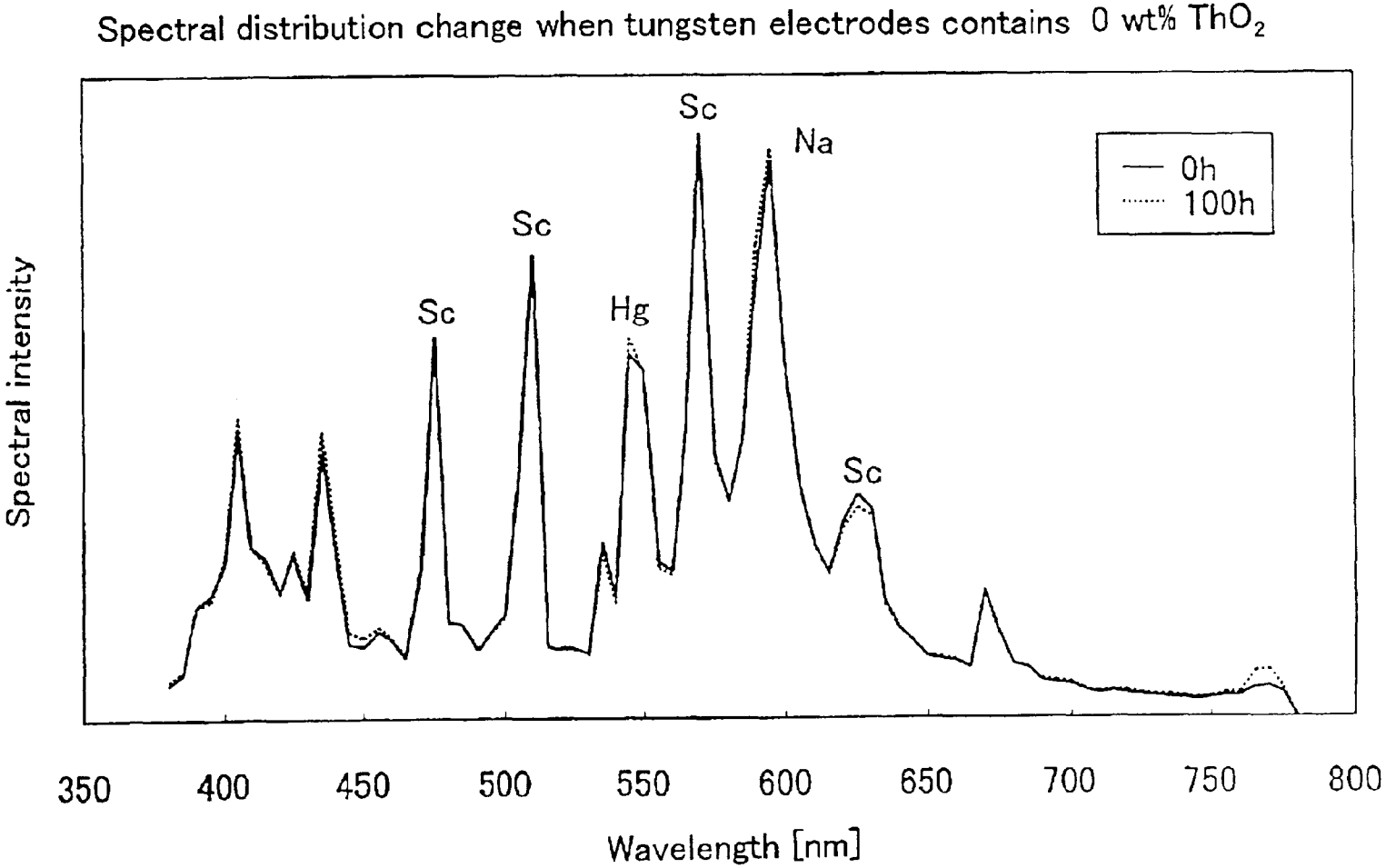
FIG. 8 is a graph showing a spectral distribution during the lifetime of a metal halide lamp depending on an amount of $ThO_2$ contained in tungsten electrodes of the lamp.
Figure 9:
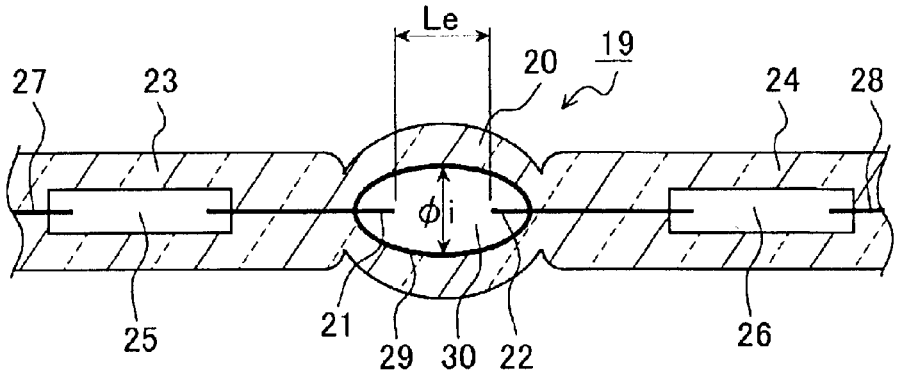
FIG.9 PRIOR ART
FIG. 9 is a cross-sectional view showing an arc tube of a conventional metal halide lamp for an automobile headlight.
Figure 10:
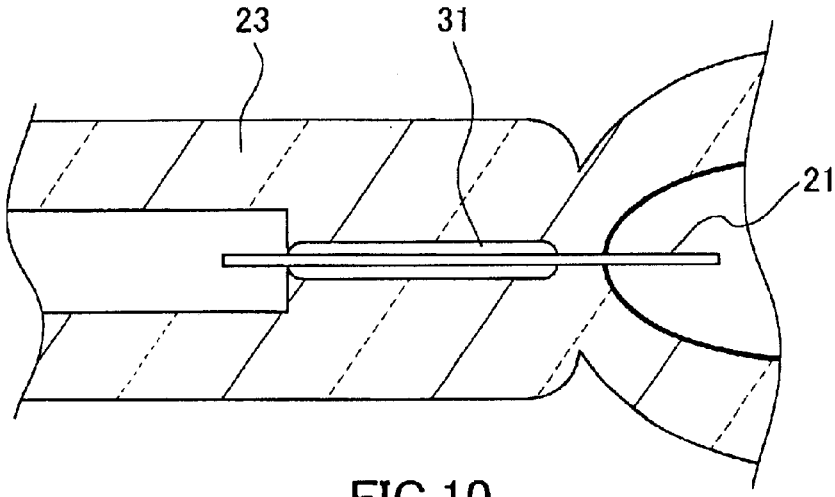
FIG.10 PRIOR ART
FIG. 10 is an enlarged cross-sectional view showing a sealing end part of an envelope of an arc tube of a conventional lamp with tungsten electrodes containing $ThO_2$.
Figure 11:
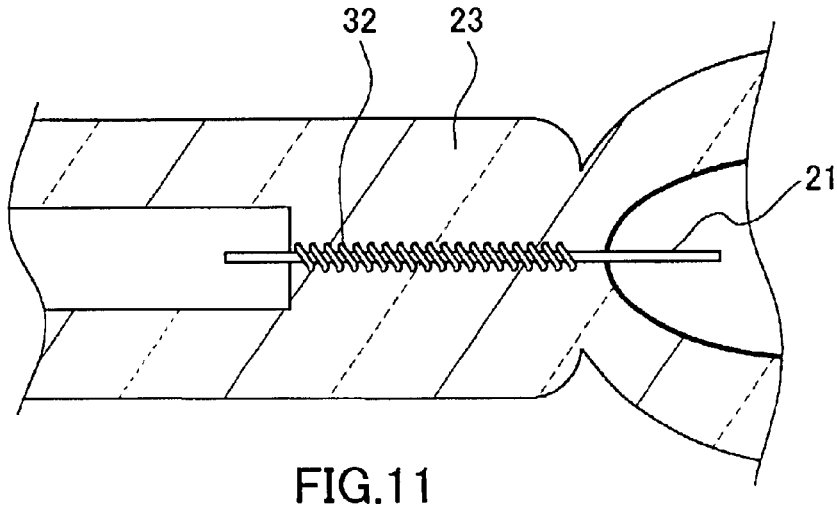
FIG.11 PRIOR ART
FIG. 11 is an enlarged cross-sectional view showing a sealing end part of an envelope of an arc tube of a conventional lamp with tungsten electrodes around which tungsten coils are wound.

The inventors of the present invention examined the life characteristics of a lamp 15 in which an amount of $ThO_2$ as an additive contained in tungsten electrodes 3 and 4 in an arc tube 1 having the structure as shown in FIG. 1 was decreased gradually from 1.0 wt % to 0 wt % according to the same life test as described above. In this case, 0.2 mg of a mixture containing sodium iodide, scandium iodide, and thorium iodide in the same composition ratio as described above, i.e., $NaI:ScI_3:ThI_4$=70 wt %:29 wt %:1 wt % was sealed in the arc tube of the lamp as a luminescent material 13. As a result, it was found that, as the amount of $ThO_2$ contained in the tungsten electrodes decreased, life characteristics: (a) a lumen maintenance factor, (b) change in color temperature, (c) change in inner diameter of the arc tube, and (d) the maximum luminance maintenance factor of the arc, were all improved. In addition, as shown in FIG. 8, the decrease in the spectral intensity of Sc after 100 hours of lighting also was suppressed. In FIGS. 3 to 6, values of the above-mentioned life characteristics (a) to (d) after 2000 hours of lighting are compared with the amounts of $ThO_2$ contained in the tungsten electrodes to show the relationships between the respective life characteristics and the amounts of $ThO_2$. First, as can be seen from FIG. 3, it is necessary that the tungsten electrodes contain only 0.4 wt % or less $ThO_2$ in order that the average lumen maintenance factor, which is the most important life characteristic, reaches the required value of 70% or more during the targeted lifetime of 2000 hours. Further, as can be seen from FIGS. 4 to 6, in order to obtain a high-quality lamp having a further improved lumen maintenance factor and other various life characteristics, it is preferable that the tungsten electrodes contain not more than 0.2 wt % $ThO_2$.

From the above-mentioned examination, it can be said that the degradation of the life characteristics caused by the addition of $ThO_2$ according to the prior art is attributed to the following mechanism: in particular, (1) during the lifetime of the lamp, oxygen ($O_2$) is dissociated and released from $ThO_2$ to react with $ScI_3$ in the luminescent material 13, thereby exhausting $ScI_3$ in the arc tube 1; and also, (2) $Sc_2O_3$ generated reacts with the envelope 2 made of quartz, thereby accelerating the devitrification and the increase in an inner diameter of the arc tube 1 caused by the recrystallization of the quartz. Thus, in the present invention, the tungsten electrodes contain a smaller amount of $ThO_2$ as compared with those in the conventional lamp in order to basically suppress the reactions described in the above-mentioned (1) and (2), thereby suppressing the exhaustion of $ScI_3$ and the devitrification of the envelope made of quartz.

On the other hand, the same life test was conducted with respect to a lamp 15 in which tungsten electrodes 3 and 4 containing 0 wt % $ThO_2$ were employed according to the present invention and the amount of the luminescent material 13 containing NaI, $ScI_3$, and $ThI_4$ in the same composition ratio as described above sealed in the arc tube was increased gradually from 0.2 mg to 1.0 mg. As a result, it was found that cracks and/or damage newly occurred in the quartz present in the vicinity of the electrode-side ends of the molybdenum foils 7 and 8 and devitrification of the envelope 2 of the arc tube 1 became considerable with an increase in an amount of $ScI_3$, similarly to the above-mentioned case.

In the structure of the arc tube 1 according to the present embodiment as shown in FIG. 1, when the amount of $ThO_2$ contained in the tungsten electrodes is decreased according to the present invention, cracks and/or damage are liable to occur in the quartz present around the sealed portions of the tungsten electrodes 3 and 4 in the sealing end parts 5 and 6 of the envelope, as specifically described above in connection with the prior art. Therefore, in the present invention, it is preferable that means for preventing this is used in combination. In the structure according to the present embodiment as shown in FIG. 1, as a particularly effective means, tungsten coils 11 and 12 are wound around the sealed portion of the tungsten electrodes 3 and 4. The tungsten coils 11 and 12 serve as a buffer member for reducing stress distortion due to a difference in thermal expansion between the tungsten electrodes and the arc tube. Another example of such means is to coat the sealed portions of the tungsten electrodes in the sealing end parts of the envelope with rhenium, platinum, rhodium, ruthenium, gold, or the like.

Figure 14:
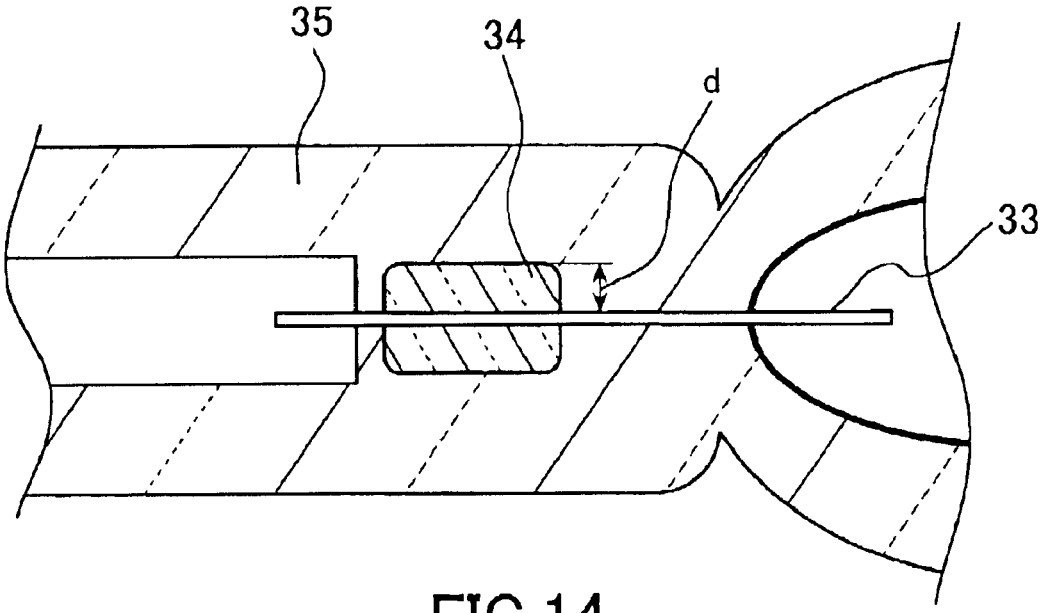
FIG. 14 is an enlarged cross-sectional view showing a sealing end part of an envelope of an arc tube of a lamp with tungsten electrodes provided with an intermediate sealing glass.

As the above-mentioned buffer member, an intermediate sealing glass having a thermal expansion coefficient smaller than that of tungsten and greater than that of quartz may be used. FIG. 14 is an enlarged cross-sectional view showing a sealing end part 35 of an envelope of an arc tube of a lamp with a tungsten electrode 33 provided with an intermediate sealing glass 34. In FIG. 14, it is preferable that the intermediate sealing glass 34 has a thickness d of at least 0.1 mm to facilitate the manufacture of the lamp. Examples of this intermediate sealing glass include: superhard glass (thermal expansion coefficient: $32\times10^{-7}$/° C.), GSC-No1 (thermal expansion coefficient: $12.8\times10^{-7}$/° C.) available from General Electric Company; GSC-No3 (thermal expansion coefficient: $17\times10^{-7}$/° C.) available from General Electric Company; 8228 (thermal expansion coefficient: $13\times10^{-7}$/° C.) available from Schott Corporation; a sintered body containing molybdenum and/or tungsten mixed in microcrystals of quartz glass or Vycor glass; and a graded material made of a sintered body containing molybdenum and/or tungsten mixed in microcrystals of quartz glass or Vycor glass, in which an amount of molybdenum and/or tungsten increases as the distance between the tungsten electrode and the intermediate sealing glass becomes shorter.

Figure 15:
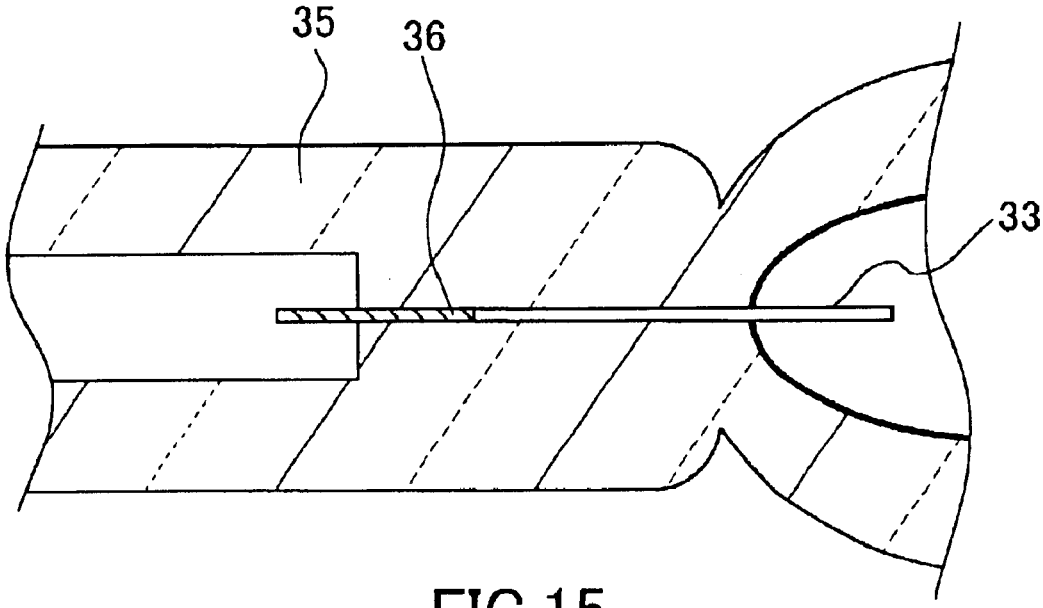
FIG. 15 is an enlarged cross-sectional view showing a sealing end part of an envelope of an arc tube of a lamp with tungsten electrodes provided with a conductive member.

In addition, it is also possible to electrically connect the tungsten electrodes and the metal foils, respectively, via a buffer member for reducing stress distortion due to a difference in thermal expansion between the tungsten electrodes and the arc tube. The buffer member preferably is a conductive member having a thermal expansion coefficient smaller than that of tungsten and greater than that of quartz. FIG. 15 is an enlarged cross-sectional view showing a sealing end part 35 of an envelope of an arc tube of a lamp with a tungsten electrode 33 provided with a conductive member 36. As the conductive member 36, rhenium, ruthenium, platinum, or the like preferably is used.

While tungsten electrodes in a lamp according to the present invention contain a smaller amount of $ThO_2$ as compared with those in the conventional lamp, the blackening of the arc tube caused by evaporation and/or wear of the tungsten electrodes also was suppressed and desired life characteristics were obtained. The reason for this basically is that xenon as a buffer gas 14 was sealed in the arc tube at a high pressure of 0.7 MPa. Conventionally, in a conventional NaI—$ScI_3$-based lamp for general lighting, only argon (Ar) is sealed at a pressure of about 25 kPa. In fact, in a lamp 15 in which tungsten electrodes 3 and 4 in an arc tube 1 having the structure of FIG. 1 contained 0 wt % $ThO_2$ and a pressure of the xenon sealed in the arc tube was decreased gradually, the blackening of the arc tube caused by evaporation and/or wear of the tungsten electrodes became considerable and the required average lumen maintenance factor of 70% during the lifetime of 2000 hours could not be achieved when the pressure of the xenon was below 0.4 MPa.

Figure 12:
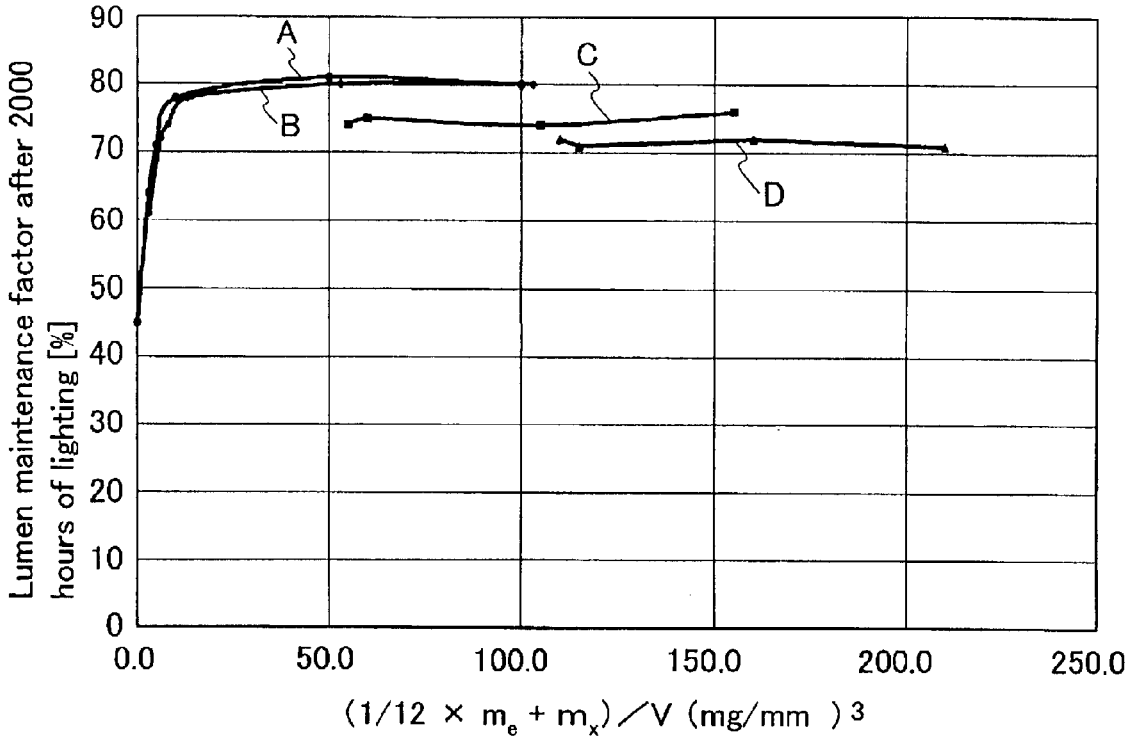
FIG. 12 is a graph showing the relationship between the lumen maintenance factor after 2000 hours of lighting and an amount of thorium elements present in an arc tube.
Figure 13:
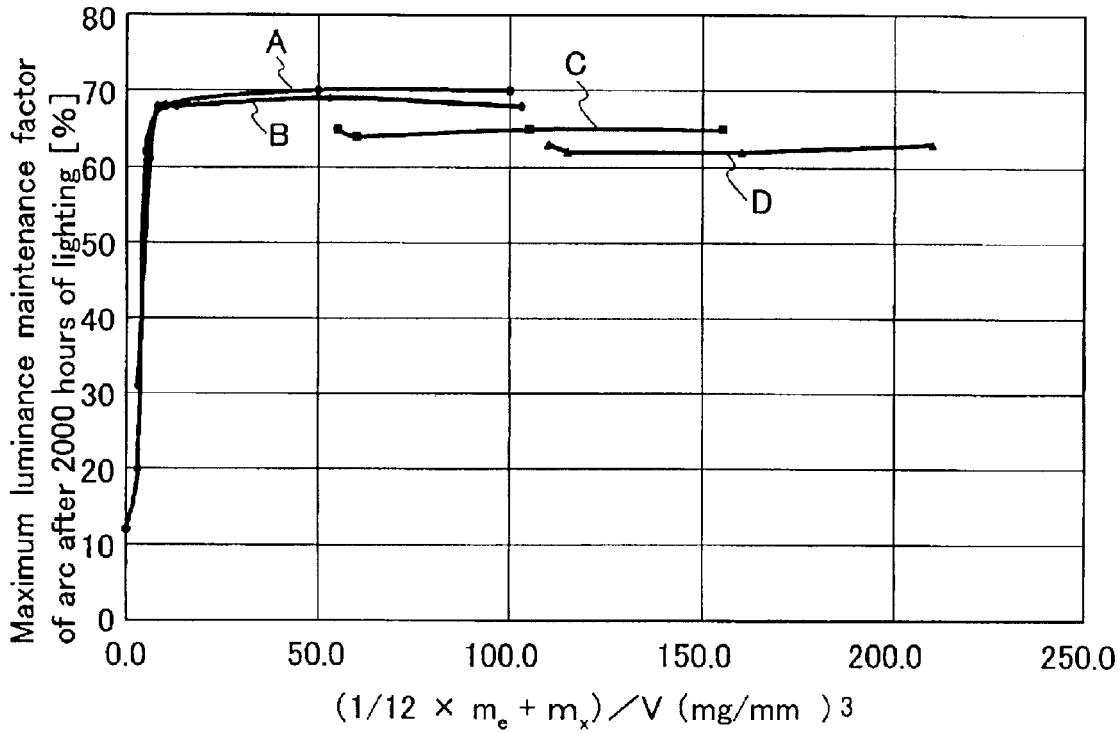
FIG. 13 is a graph showing the relationship between the maximum luminance maintenance factor of the arc after 2000 hours of lighting and an amount of thorium elements present in an arc tube.

Further, the lumen maintenance factor and the maximum luminance maintenance factor of the arc after 2000 hours of lighting were measured with the value of $(1/12\times m_e+m_x)/V$ being varied by changing an amount of $ThI_4$ sealed in an arc tube. In $(1/12\times m_e+m_x)/V$, V ($mm^3$) represents an inner volume of the arc tube, $m_e$ (mg) represents a total weight of thorium elements contained in portions of the tungsten electrodes protruding into a hollow space inside the arc tube, and $m_x$ (mg) represents a total weight of thorium elements present in the hollow space except for those contained in the portions of the tungsten electrodes protruding into the hollow space. The results of the measurement are shown in FIGS. 12 and 13. As can be seen from FIGS. 12 and 13, when the relationship $(1/12 \times m_e + m_x)/V \geqq 5$ (mg/mm$^3$) is satisfied, the lamp can achieve a lumen maintenance factor of 70% or more and the maximum luminance maintenance factor of the arc of 60% or more.

In FIGS. 12 and 13, "A" represents data in the case where tungsten electrodes contain 0 wt % $ThO_2$; "B" represents data in the case where tungsten electrodes contain 0.001 wt % $ThO_2$; "C" represents data in the case where tungsten electrodes contain 0.2 wt % $ThO_2$; and "D" represents data in the case where tungsten electrodes contain 0.4 wt % $ThO_2$. The tungsten electrode bars used in the above measurement were 0.25 mm in diameter, the length of the portions of the tungsten electrodes protruding inside the arc tube was 1.0 mm, and the inner volume of the arc tube was 25 mm$^3$.

It is to be noted here that thorium elements contained in the tungsten electrodes can produce an effect only after it is diffused through the solids to reach front ends of the tungsten electrodes. That is to say, not all the thorium elements can produce effect. On this account, the coefficient 1/12 is necessary in the above inequality.

In the arc tube 1 having the structure according to the present embodiment, as the luminescent material 13, other metal halide materials such as LiI, TlI, and the like also may be sealed in the arc tube.

As a result of the above-mentioned results, it was demonstrated that, although it has been conventionally widely accepted that the addition of $ThO_2$ is effective in improving life characteristics of a high-pressure discharge lamp, life characteristics are degraded by adding $ThO_2$ in a small metal halide lamp for an automobile headlight, which the present invention aims to provide. The reason for this basically is as follows. Unlike a conventional NaI—$ScI_3$-based metal halide lamp for general lighting, a metal halide lamp for an automobile headlight has a small arc tube with an inner volume of 30 mm$^3$ at maximum. Thus, in the metal halide lamp for an automobile headlight, an absolute value of $ScI_3$ sealed in the arc tube is relatively small as compared with an amount of $O_2$ released from $ThO_2$.

Industrial Applicability

As specifically described above, the present invention provides a metal halide lamp for an automobile headlight that includes an arc tube in which a pair of tungsten electrodes are provided at both ends and a metal halide as a main component of a luminescent material and xenon gas as a buffer gas are sealed, wherein the tungsten electrodes contain not more than 0.4 wt % of thorium oxide, and the metal halide contains scandium iodide. This makes it possible to improve a lumen maintenance factor and other life characteristics and thus to obtain a long-life lamp having a lifetime of 2000 hours or more.

What is claimed is:

1. A metal halide lamp for an automobile headlight comprising an arc tube in which a pair of tungsten electrodes are provided at both ends and a metal halide as a main component of a luminescent material and xenon gas as a buffer gas are sealed, wherein the tungsten electrodes contain not more than 0.4 wt % of thorium oxide, and the metal halide contains scandium iodide; and the following relationship is satisfied:

$$(1/12 m_e + m_x)/V \geqq 5 \text{ (mg/mm}^3\text{)}$$

where V (mm$^3$) represents an inner volume of the arc tube, $m_e$ (mg) represents a total weight of thorium elements contained in portions of the tungsten electrodes protruding into a hollow space inside the arc tube, and $m_x$ represents a total weight of thorium elements present in the hollow space except for those contained in the portions of the tungsten electrodes protruding into the hollow space.

2. The metal halide lamp for an automobile headlight according to claim 1, wherein the tungsten electrodes contain not more than 0.2 wt % of thorium oxide.

3. The metal halide lamp for an automobile headlight according to claim 1, wherein the metal halide contains sodium iodide.

4. The metal halide lamp for an automobile headlight according to claim 1, wherein, between each of the tungsten electrodes and the arc tube, a buffer member for reducing stress distortion due to a difference in thermal expansion between each of the tungsten electrodes and the arc tube is provided.

5. The metal halide lamp for an automobile headlight according to claim 4, wherein the buffer member is an intermediate sealing glass having a thermal expansion coefficient smaller than that of tungsten and greater than that of quartz.

6. The metal halide lamp for an automobile headlight according to claim 4, wherein the buffer member is a tungsten coil wound around a portion of each of the tungsten electrodes that is sealed in a sealing end part of an envelope.

7. The metal halide lamp for an automobile headlight according to claim 1, wherein a portion of each of the tungsten electrodes that is sealed in a sealing end part of an envelope is coated with at least one material selected from the group consisting of rhenium, platinum, rhodium, ruthenium, and gold.

8. The metal halide lamp for an automobile headlight according to claim 1, wherein a metal foil is sealed in each sealing end part of an envelope of the arc tube, and each of the tungsten electrodes is connected electrically to the metal foil via a buffer member for reducing stress distortion due to a difference in thermal expansion between each of the tungsten electrode and the arc tube.

9. The metal halide lamp for an automobile headlight according to claim 8, wherein the buffer member is a conductive member having a thermal expansion coefficient smaller than that of tungsten and greater than that of quartz.

10. A metal halide lamp for an automobile headlight comprising an arc tube in which a pair of tungsten electrodes are provided at both ends and a metal halide as a main component of a luminescent material and xenon gas as a buffer gas are sealed, wherein the tungsten electrodes contain not more than 0.4 wt % of thorium oxide, the metal halide contains scandium iodide, and a pressure of the xenon sealed in the arc tube is at least 0.4 MPa, and the following relationship is satisfied:

$$(1/12 m_e + m_x)/V \geqq 5 \text{ (mg/mm}^3\text{)}$$

where V (mm$^3$) represents an inner volume of the arc tube, $m_e$ (mg) represents a total weight of thorium elements contained in portions of the tungsten electrodes protruding into a hollow space inside the arc tube, and $m_x$ (mg) represents a total weight of thorium elements present in the hollow space except for those contained in the portions of the tungsten electrodes protruding into the hollow space.

11. The metal halide lamp for an automobile headlight according to claim 10, wherein the tungsten electrodes contain not more than 0.2 wt % of thorium oxide.

12. The metal halide lamp for an automobile headlight according to claim 10, wherein the metal halide contains sodium iodide.

13. The metal halide lamp for an automobile headlight according to claim 10, wherein, between each of the tungsten electrodes and the arc tube, a buffer member for reducing stress distortion due to a difference in thermal expansion between each of the tungsten electrodes and the arc tube is provided.

14. The metal halide lamp for an automobile headlight according to claim 13, wherein the buffer member is an intermediate sealing glass having a thermal expansion coefficient smaller than that of tungsten and greater than that of quartz.

15. The metal halide lamp for an automobile headlight according to claim 13, wherein the buffer member is a tungsten coil wound around a portion of each of the tungsten electrodes that is sealed in a sealing end part of an envelope.

16. The metal halide lamp for an automobile headlight according to claim 10, wherein a portion of each of the tungsten electrodes that is sealed in a sealing end part of an envelope is coated with at least one material selected from the group consisting of rhenium, platinum, rhodium, ruthenium, and gold.

17. The metal halide lamp for an automobile headlight according to claim 10, wherein a metal foil is sealed in each sealing end part of an envelope of the arc tube, and each of the tungsten electrodes is connected electrically to the metal foil via a buffer member for reducing stress distortion due to a difference in thermal expansion between each of the tungsten electrode and the arc tube.

18. The metal halide lamp for an automobile headlight according to claim 17, wherein the buffer member is a conductive member having a thermal expansion coefficient smaller than that of tungsten and greater than that of quartz.

19. A metal halide lamp for an automobile headlight comprising an arc tube in which a pair of tungsten electrodes are provided at both ends and a metal halide as a main component of a luminescent material and xenon gas as a buffer gas are sealed, wherein the tungsten electrodes contain not more than 0.4 wt % of thorium oxide, the metal halide contains scandium iodide, and a lamp current at least three times higher than that applied during steady-state lighting is applied to the metal halide lamp during a period after the lamp is turned on and until the steady-state lighting is established, and the following relationship is satisfied:

$$(1/2\,m_e+m_x)/V \geqq 5 \text{ (mg/mm}^3\text{)}$$

where V ($mm^3$) represents an inner volume of the arc tube, $m_e$ (mg) represents a total weight of thorium elements contained in portions of the tungsten electrodes protruding into a hollow space inside the arc tube, and $m_x$ (mg) represents a total weight of thorium elements present in the hollow space except for those contained in the portions of the tungsten electrodes protruding into the hollow space.

20. The metal halide lamp for an automobile headlight according to claim 19, wherein the tungsten electrodes contain not more than 0.2 wt % of thorium oxide.

21. The metal halide lamp form automobile headlight according to claim 19, wherein the metal halide contains sodium iodide.

22. The metal halide lamp for an automobile headlight according to claim 19, wherein, between each of the tungsten electrodes and the arc tube, a buffer member for reducing stress distortion due to a difference in thermal expansion between each of the tungsten electrodes and the arc tube is provided.

23. The metal halide lamp for an automobile headlight according to claim 22, wherein the buffer member is an intermediate sealing glass having a thermal expansion coefficient smaller than that of tungsten and greater than that of quartz.

24. The metal halide lamp for an automobile headlight according to claim 22, wherein the buffer member is a tungsten coil wound around a portion of each of the tungsten electrodes that is sealed in a sealing end part of an envelope.

25. The metal halide lamp for an automobile headlight according to claim 19, wherein a portion of each of the tungsten electrodes that is sealed in a sealing end part of an envelope is coated with at least one material selected from the group consisting of rhenium, platinum, rhodium, ruthenium, and gold.

26. The metal halide lamp for an automobile headlight according to claim 19, wherein a metal foil is sealed in each sealing end part of an envelope of the arc tube, and each of the tungsten electrodes is connected electrically to the metal foil via a buffer member for reducing stress distortion due to a difference in thermal expansion between each of the tungsten electrode and the arc tube.

27. The metal halide lamp for an automobile headlight according to claim 26, wherein the buffer member is a conductive member having a thermal expansion coefficient smaller than that of tungsten and greater than that of quartz.

* * * * *